US011363683B2

(12) United States Patent
Han et al.

(10) Patent No.: US 11,363,683 B2
(45) Date of Patent: Jun. 14, 2022

(54) PTC RADIANT HEATING SYSTEM AND METHOD

(71) Applicant: GM GLOBAL TECHNOLOGY OPERATIONS LLC, Detroit, MI (US)

(72) Inventors: Taeyoung Han, Bloomfield Hills, MI (US); Shailendra Kaushik, Novi, MI (US); Kuo-huey Chen, Troy, MI (US); Chih-hung Yen, Boomfield Hills, MI (US); Bahram Khalighi, Birmingham, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 619 days.

(21) Appl. No.: 15/953,738

(22) Filed: Apr. 16, 2018

(65) Prior Publication Data

US 2019/0320503 A1 Oct. 17, 2019

(51) Int. Cl.
*H05B 3/74* (2006.01)

(52) U.S. Cl.
CPC ..... *H05B 3/748* (2013.01); *H05B 2203/029* (2013.01)

(58) Field of Classification Search
CPC ..... B60H 1/00735; B60H 1/0073; B60H 1/00892; B60H 1/2218; B60H 1/2226; B60H 1/2225; B60H 1/00792; B60W 50/0098; B60W 2050/0002; B60L 1/02
USPC ..... 219/448.13, 202, 482
See application file for complete search history.

(56) References Cited

U.S. PATENT DOCUMENTS

| | | | | |
|---|---|---|---|---|
| 6,407,365 | B1 | 6/2002 | De Prete, III | |
| 6,852,955 | B1 | 2/2005 | Golan et al. | |
| 7,994,080 | B2 | 8/2011 | Teoret et al. | |
| 9,717,115 | B2 | 7/2017 | Li | |
| 9,873,309 | B2 | 1/2018 | Sagou | |
| 10,583,713 | B2 | 3/2020 | Sagou | |
| 2010/0019050 | A1* | 1/2010 | Han | B60H 1/00807 236/44 C |
| 2011/0127246 | A1* | 6/2011 | Heiden | B60H 1/2226 219/202 |
| 2012/0234932 | A1* | 9/2012 | Okamoto | F24H 3/102 237/2 R |
| 2013/0068440 | A1* | 3/2013 | Kamiyama | B60H 1/00878 165/202 |

(Continued)

FOREIGN PATENT DOCUMENTS

| | | | |
|---|---|---|---|
| DE | 102013006410 | A1 | 12/2013 |
| DE | 112014001899 | T5 | 2/2016 |

(Continued)

OTHER PUBLICATIONS

Chen, K., et al. U.S. Patent Application entitled "Window Shade System With Radiant Heating".

*Primary Examiner* — Tu B Hoang
*Assistant Examiner* — Alba T Rosario-Aponte
(74) *Attorney, Agent, or Firm* — Lorenz & Kopf LLP

(57) ABSTRACT

Systems and methods are provided for radiant heating by PTC radiant patches. A radiant heating system for warming an occupant of an enclosed space includes patches to radiate heat into the enclosed space toward the occupant. A power supply supplies electric power to the patches. A controller controls the electric power supplied to the patches based on a temperature in the enclosed space and locations of the patches within the enclosed space.

20 Claims, 5 Drawing Sheets

(56) References Cited

U.S. PATENT DOCUMENTS

| | | | | |
|---|---|---|---|---|
| 2016/0046174 | A1* | 2/2016 | Sagou | G05D 23/1919 392/375 |
| 2016/0068044 | A1* | 3/2016 | Sagou | H05B 3/20 165/203 |
| 2016/0167482 | A1* | 6/2016 | Oh | B60H 1/2225 219/202 |
| 2016/0270158 | A1 | 9/2016 | Comoglio et al. | |
| 2017/0138627 | A1 | 5/2017 | Han et al. | |
| 2019/0047366 | A1* | 2/2019 | Elson | H05B 3/34 |

FOREIGN PATENT DOCUMENTS

| | | | |
|---|---|---|---|
| DE | 102015111442 | A1 | 1/2017 |
| DE | 112015002482 | T5 | 3/2017 |

* cited by examiner

PTC RADIANT HEATING SYSTEM AND METHOD

TECHNICAL FIELD

The present disclosure generally relates to systems and methods for controlling the temperature of a space, and more particularly relates to systems with positive thermal coefficient (PTC), radiant heating devices.

INTRODUCTION

The development of HVAC systems that deliver adequate thermal comfort at lower cost and higher fuel-efficiency is a challenge. Providing a comfortable environment for occupants of a space typically involves conditioning through the use of climate control such as through a heating, ventilating and air conditioning (HVAC) system. Providing a HVAC system enables maintaining a comfortable environment for occupants by adding or removing heat from the space. The HVAC system therefore works to counter unwanted heat or cold. Such systems often have a time lag between start-up and achieving a desirable comfort level, particularly when a space has been unheated for an extended period of time. When heat loss or infiltration occurs or when surrounding components are at a low temperature, an occupant feels cold and the HVAC system only indirectly addresses those sources by warming internal air.

In vehicle applications, the current powertrain trends indicate that as engines become more fuel-efficient, the amount of waste heat from these engines is significantly reduced. This creates additional challenges in providing thermal comfort of vehicle occupants, especially during the cold-soak, warm-up phase of vehicle operation. The issue becomes further challenging for vehicles with alternative powertrains such as hybrid and electric vehicles as there is little to no waste heat from internal combustion engines. Therefore, in certain applications, a HVAC system may have and undesirably long response time or a limited capacity for space heating. In other applications there is a preference to reduce energy usage of a HVAC system.

Accordingly, it is desirable to provide systems and methods that efficiently and effectively provide heating for a broad range of applications. Furthermore, other desirable features and characteristics of system structures and methods for thermal control will become apparent from the subsequent detailed description and the appended claims, taken in conjunction with the accompanying drawings and the foregoing technical field and background.

SUMMARY

Radiant heating systems and methods using PTC patches are provided. In a number of embodiments, a radiant heating system for warming an occupant of an enclosed space includes a patch configured to radiate heat into the enclosed space toward the occupant. At least one other patch is also configured to radiate heat into the enclosed space toward the occupant. A power supply is configured to supply electric power to the patches. A controller is configured to control the electric power supplied to the patches based on a temperature in the enclosed space and based on locations of the patches within the enclosed space.

In an additional embodiment, the controller controls the supply of electric power based on an occupant comfort level.

In an additional embodiment, the radiant heating system is associated with a HVAC system that includes a blower.

The controller is configured to supply electric current to the patches and to stop the blower when the temperature in the enclosed space is lower than a comfortable range.

In an additional embodiment, a sensor is configured to determine an ambient temperature outside the enclosed space, and another sensor is configured to determine a cabin temperature inside the enclosed space. The controller is configured to control the supply of electric current to the patches based on the ambient temperature and the cabin temperature.

In an additional embodiment, the enclosed space is a cabin of a vehicle with lower dash panel on which one patch is positioned, and a door on which another patch is positioned. The controller is configured, at a given temperature, to reduce the power to the first patch while maintaining a constant power level to the second patch.

In an additional embodiment, the patches are each comprised of a positive thermal coefficient material that exhibits an electrical resistance that increases exponentially as a patch temperature of the patches rises.

In an additional embodiment, the patches are configured to use approximately no power above a set temperature, while the power supply remains on.

In a number of other embodiments, a radiant heating system for warming an occupant of a vehicle with a cabin, the system includes at least one patch configured to radiate heat into the enclosed space toward the occupant. A power supply is connected with the patch. A HVAC system is configured to condition the cabin to a set temperature. A controller is configured to control the power supply to supply electric current to the patch, and to control the HVAC system. The power supply and the HVAC system are controlled in coordination based on the set temperature.

In an additional embodiment, the controller is configured to determine equivalent homogeneous temperature in the cabin, and when the equivalent homogeneous temperature approaches the set temperature, signal the power supply to reduce current to the patch.

In an additional embodiment, the HVAC system includes a blower and the controller is configured to increase speed of the blower when the current to the patch is reduced.

In a number of additional embodiments, a method of warming an occupant of an enclosed space includes positioning a radiant patch at a given location to radiate heat into the enclosed space toward the occupant. Another radiant patch is positioned at another location to radiate heat into the enclosed space toward the occupant. A power supply is connected to the patches. A controller monitors a temperature in the enclosed space. Electric power is supplied from the power supply to the patches based on the temperature in the enclosed space and based on the locations of the patches within the enclosed space.

In an additional embodiment, the enclosed space is a vehicle. One radiant patch is positioned on a lower dash panel and another radiant patch is positioned on a door. At a given temperature, the controller reduces the electric power to the one patch while maintaining a constant electric power level to the other patch.

In an additional embodiment, another radiant patch is positioned on a roof of the vehicle. When the temperature is below a threshold temperature, electric power is supplied to all the radiant patches.

In an additional embodiment, an equivalent homogeneous temperature is determined in the enclosed space using the temperature. When the equivalent homogeneous temperature approaches a set temperature, the power supply is signaled to reduce current to the patches.

In an additional embodiment, the patches are made of a positive thermal coefficient material that exhibits an electrical resistance that increases exponentially as a patch temperature of the patches rises.

In an additional embodiment, a HVAC system conditions the enclosed space to a set temperature. The power supply and the HVAC system are controlled in coordination based on the temperature, wherein the temperature characterizes comfort of the occupant.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
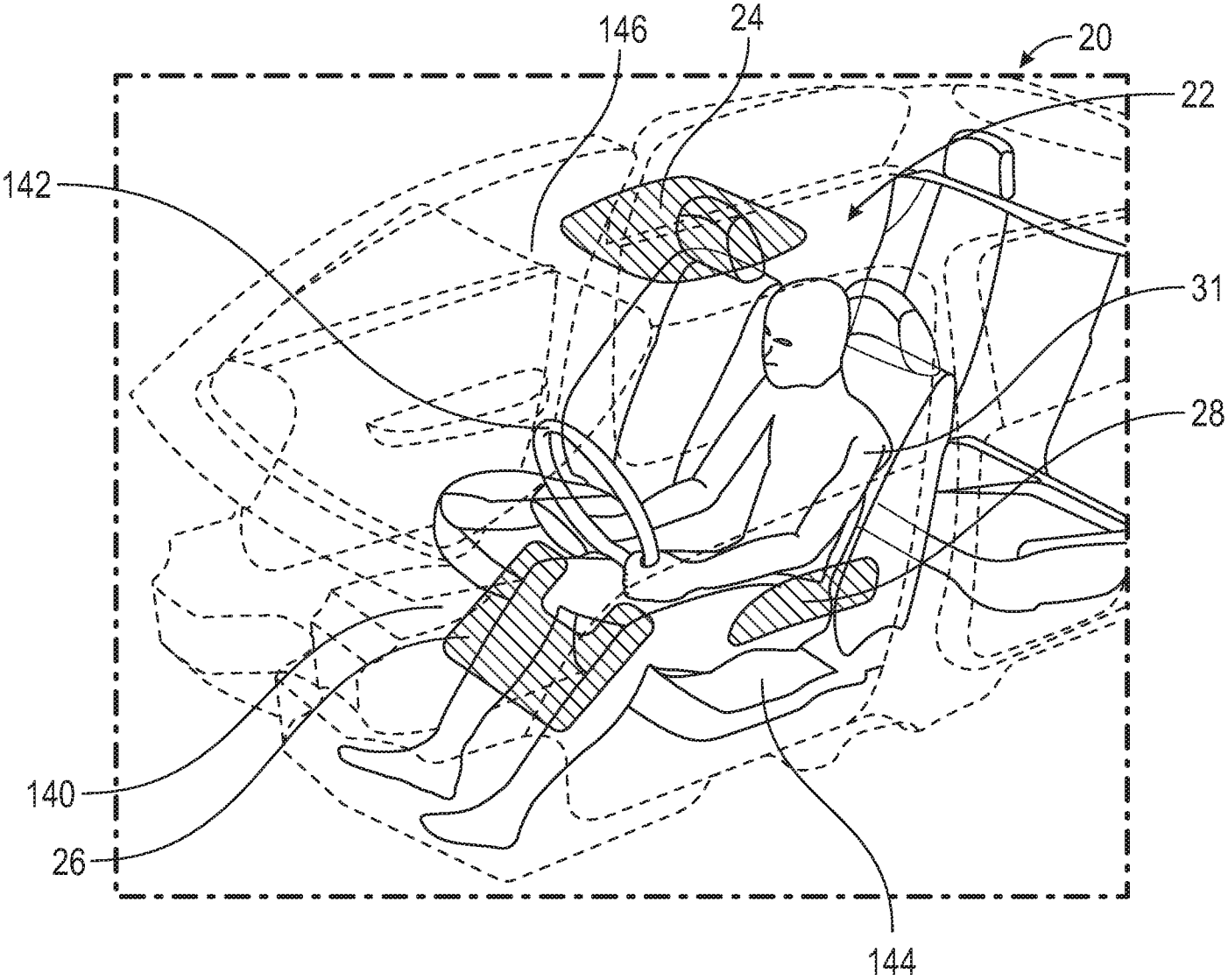
FIG. 1 is a schematic illustration of a vehicle including PTC radiant heating, in accordance with various embodiments.

The following detailed description is merely exemplary in nature and is not intended to limit the application or its uses. Furthermore, there is no intention to be bound by any expressed or implied theory presented in the preceding technical field, introduction, brief summary or the following detailed description. As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the systems described herein are merely exemplary embodiments of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

As described in more detail below, PTC radiant patches are implemented in the interior of an enclosed space such as the occupant compartment of a motor vehicle. Fast occupant thermal comfort is achieved through nearly instantaneous radiant heat at low power consumption. The PTC patch system avoids overheating, including of the cabin, by self-regulating power characteristics. The PTC radiant patches target specific occupant body segments based on view factors between the radiant patches and occupant body segments. Multi-zone radiant patch temperatures are delivered based on an occupant thermal comfort at an optimal power consumption. Surface temperatures of the PTC patches are determined to improve occupant thermal comfort using Equivalent Homogenous Temperature (EHT).

Figure 2:
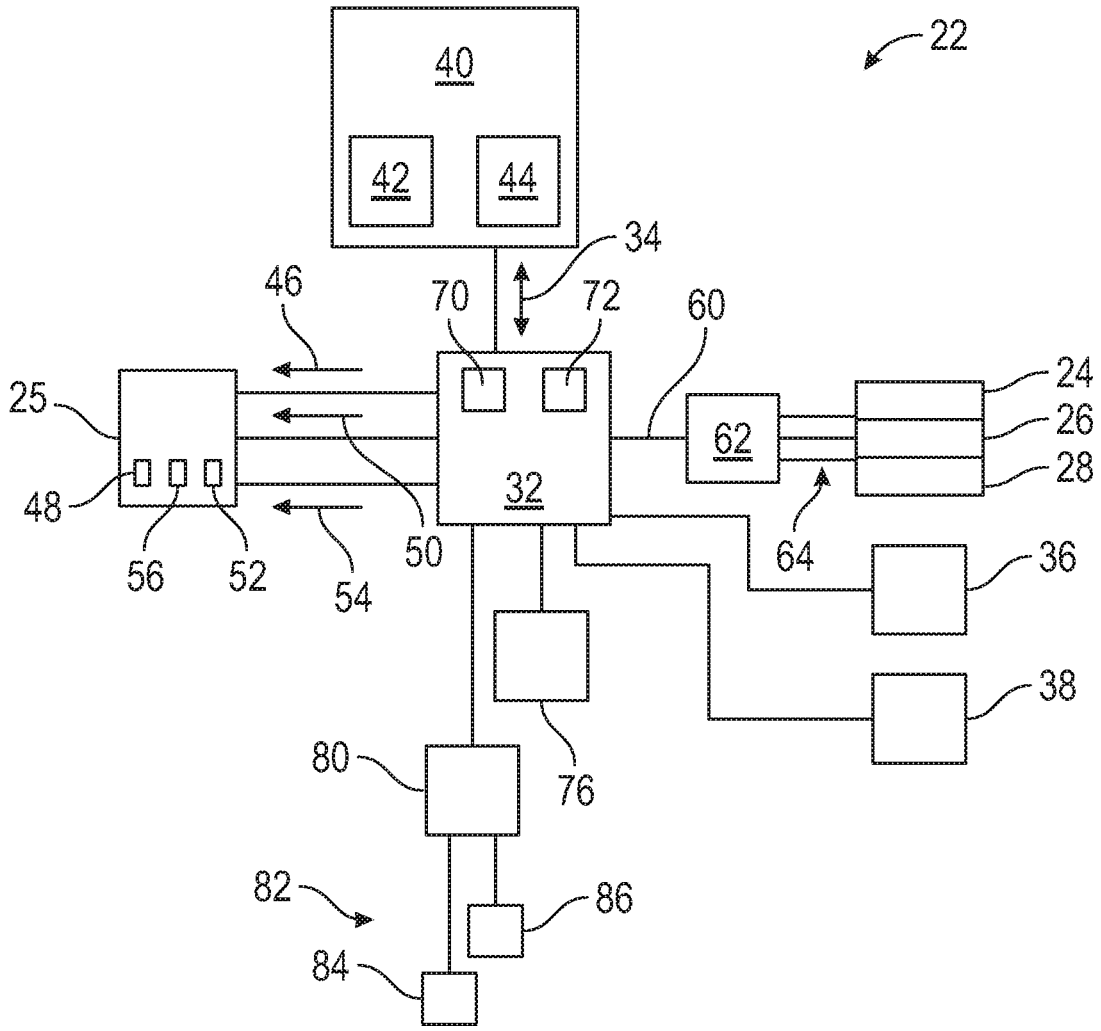
FIG. 2 is a block diagram illustrating the PTC radiant heating system of the vehicle of FIG. 1, in accordance with various embodiments.

FIG. 1 illustrates a device for housing occupants, according to an exemplary embodiment. In the current example, the device is a vehicle 20 and specifically is a ground vehicle such as an automobile of any one of a number of different types. In other embodiments, the vehicle 20 may be a plane, boat, another type of mobile device, or a stationary structure such as a building or container. As described in greater detail below, the vehicle 20 includes a PTC radiant heating system 22 with PTC radiant heating patches 24, 26, 28 that produce radiant heat for increasing the comfort level of occupants of the vehicle 20. Referring additionally to FIG. 2, the PTC radiant heating system 22 in general, receives inputs from sources on-board the vehicle 20, processes the inputs, and provides outputs to effect heat output. In the depicted embodiment, the PTC radiant heating system 22 generally includes, or cooperates with, an HVAC system 25. It will be appreciated that the number of radiant heating patches 24, 26, 28 will vary and any number of individual patches positioned to provide heat to any number of occupants may be included. For example, radiant heating patches may be positioned to provide radiant heat to the right, front seat passenger and/or the rear seat passengers. The PTC radiant patches 24, 26, 28, etc., may be incorporated into the interior trim components of the vehicle or may be adhered to, or otherwise secured thereon, and may be covered with trim material for an aesthetic appearance.

The vehicle 20 generally includes a body that substantially encloses components of the vehicle 20, including any occupant(s) 31. The vehicle 20 has various vehicle systems that are controlled by one or more controllers 32. These vehicle systems include the PTC radiant heating system 22 and the HVAC system 25. The PTC radiant heating system 22 includes one or more ambient air temperature sensors 36 for measuring the temperature of external ambient air ($T_a$) outside the vehicle 20. The sensor 36 is communicatively coupled with the controller 32 and provides a signal and/or other information thereto to discern $T_a$. A cabin air temperature sensor 38 is provided for measuring air temperature ($T_c$) inside the cabin of the vehicle 20. The sensor 38 is communicatively coupled with the controller 32 and provides a signal and/or other information thereto to discern $T_c$. An interface system 40 is provided, such as in the instrument panel of the vehicle 20, or at another location appropriate for the application. The interface system 40 is communicatively coupled with the controller 32 and provides signals 34 and/or other information thereto with regard to selections made by the occupant 31. The signals 34 include information from which the controller 32 discerns a temperature setting desired by occupants 31 such as the driver and front passenger of a vehicle, which is representative of a set point temperature ($T_{sp}$). The inputs $T_a$, $T_c$ and $T_{sp}$ are provided to a controller 32. The set point temperature $T_{sp}$ is provided through a control device 42 such as a button in the interface system 40. The interface system 40 also includes another control device 44, such as one or more buttons to activate/deactivate the PTC radiant patches 24, 26, 28. In a number of examples, instead of buttons, for the control devices 42, 44, the interface system 40 may comprise one or more sensors associated with user interfaces such as vehicle touch screens, rotary knobs, and/or other types of user interfaces within the vehicle 20 for receiving inputs from the occupant 31.

While the components of the PTC radiant heating system 22 are depicted as being part of the same system, it will be appreciated that in certain embodiments these features may comprise multiple systems. In addition, in various embodiments the PTC radiant heating system 22 may comprise all or part of, and/or may be coupled to, various other vehicle devices and systems, such as, among others, the HVAC system 25, and/or one or more other systems of the vehicle 20.

The controller 32 accepts information from the various sources, processes that information, and provides control commands based thereon to effect outcomes such as operation of the vehicle 20 and its systems, including the PTC radiant heating system 22. In the depicted embodiment, the controller 32 includes a processor 70, a memory device 72, and is coupled with a storage device 76. The processor 70 performs the computation and control functions of the controller 32, and may comprise any type of processor or multiple processors, single integrated circuits such as a microprocessor, or any suitable number of integrated circuit devices and/or circuit boards working in cooperation to accomplish the functions of a processing unit. During operation, the processor 70 executes one or more programs that may be contained within the storage device 76 and, as such, controls the general operation of the controller 32, generally in executing the processes described herein.

The memory device 72 may be any type of suitable memory. For example, the memory device 72 may include volatile and nonvolatile storage in read-only memory (ROM), random-access memory (RAM), and keep-alive memory (KAM), for example. KAM is a persistent or non-volatile memory that may be used to store various operating variables while the processor 70 is powered down. The memory device 72 may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 32. In certain examples, the memory device 72 is located on and/or co-located on the same computer chip as the processor 70. In the depicted embodiment, the storage device 76 stores the above-referenced programs along with one or more stored values.

The storage device 76 stores data for use in automatically controlling the vehicle 20 and its systems. The storage device 76 may be any suitable type of storage apparatus, including direct access storage devices such as hard disk drives, flash systems, floppy disk drives and optical disk drives. In one exemplary embodiment, the storage device 76 comprises a source from which the memory device 72 receives the programs that execute one or more embodiments of one or more processes of the present disclosure, such as the steps of the processes (and any sub-processes thereof) described herein. In another exemplary embodiment, a program may be directly stored in and/or otherwise accessed by the memory device 72. The programs represent executable instructions, used by the electronic controller 32 in processing information and in controlling the vehicle 20 and its systems. The instructions may include one or more separate programs, each of which comprises an ordered listing of executable instructions for implementing logical functions. The instructions, when executed by the processor 70 support the receipt and processing of signals such as from sensors, perform logic, calculations, methods and/or algorithms for automatically controlling the components and systems of the vehicle 20. The processor 70 may generate control signals for the PTC radiant heating system 22 and the HVAC system 25 for automatic control based on the logic, calculations, methods, and/or algorithms.

Methods, algorithms, or parts thereof may be implemented in a computer program product of the controller 32 including instructions or calculations carried on a computer readable medium for use by one or more processors to implement one or more of the method steps or instructions. The computer program product may include one or more software programs comprised of program instructions in source code, object code, executable code or other formats; one or more firmware programs; or hardware description language (HDL) files; and any program related data. The data may include data structures, look-up tables, or data in any other suitable format. The program instructions may include program modules, routines, programs, objects, components, and/or the like. The computer program may be executed on one processor or on multiple processors in communication with one another.

In a number of embodiments, the controller 32 produces signals 46 for delivery to an HVAC blower 48 and may set the operational state and/or speed thereof. The controller 32 produces signals 50 to set the target discharge air temperature of the HVAC system 25 through an actuator 52, such as an actuator that displaces a damper or adjusts a valve. Closed loop feedback is provided to the controller 32. The controller 32 produces signals 54 that are delivered to actuator(s) 56 to set the operational mode of the HVAC system 25 such as heating through a heater system, or cooling through an air conditioning system, or ventilating to provide outside air to the cabin. In the current embodiment, the controller 32 provides signals 60 to a power supply 62 to control the supply of power through conductors 64 to the PTC radiant patches 24, 26, 28. The PTC radiant patches 24, 26, 28 are self-regulating and provide an instantaneous warm thermal sensation to the occupant 31. The PTC radiant patches 24, 26, 28 are made of a film of silicon rubber, carbon ink, or another PTC material that may be less than one mm thick and that is flexible for forming into the available shape and size of host interior panels in the passenger compartment. Heating output is a function of temperature, giving maximum heat at lower temperature and reducing heat output and power use as temperature rises. No temperature sensors are needed to monitor the temperature of the self-regulating PTC radiant patches 24, 26, 28. The PTC radiant patches 24, 26, 28, the blower 48, the actuator 52, the actuator(s) 56, and the power supply 62 may each be communicatively coupled with the controller 32 to receive signals therefrom, directly, or indirectly such as through intermediary modules or controllers, and to provide information thereto, when relevant, such as feedback.

An occupant state system 80 includes one or more occupant state devices 82 that provide information or data on aspects of an occupant of the vehicle 20. The occupant state devices 82 may include, but are not limited to, position sensors 84 to detect the location of occupants/passengers, biometric sensors 86 for sensing biological features of an occupant, such as temperature(s), and other devices. The controller 32 uses the occupant state information to automatically determine which PTC radiant patches 24, 26, 28 to activate/deactivate for energizing through the power supply 62. For example, if the rear passenger seat does not include an occupant, then the controller 32 will not supply power to any PTC radiant patches on the rear passenger side of the vehicle 20. In some embodiments, even for a seat that does not contain an occupant, the controller 32 may be programmed to energize the adjacent PTC radiant patches, depending on the thermal state of the vehicle 20. In other embodiments, select PTC radiant patches 24, 26, 28 are energized in response to occupant 31 inputs through the interface system 40.

Figure 3:
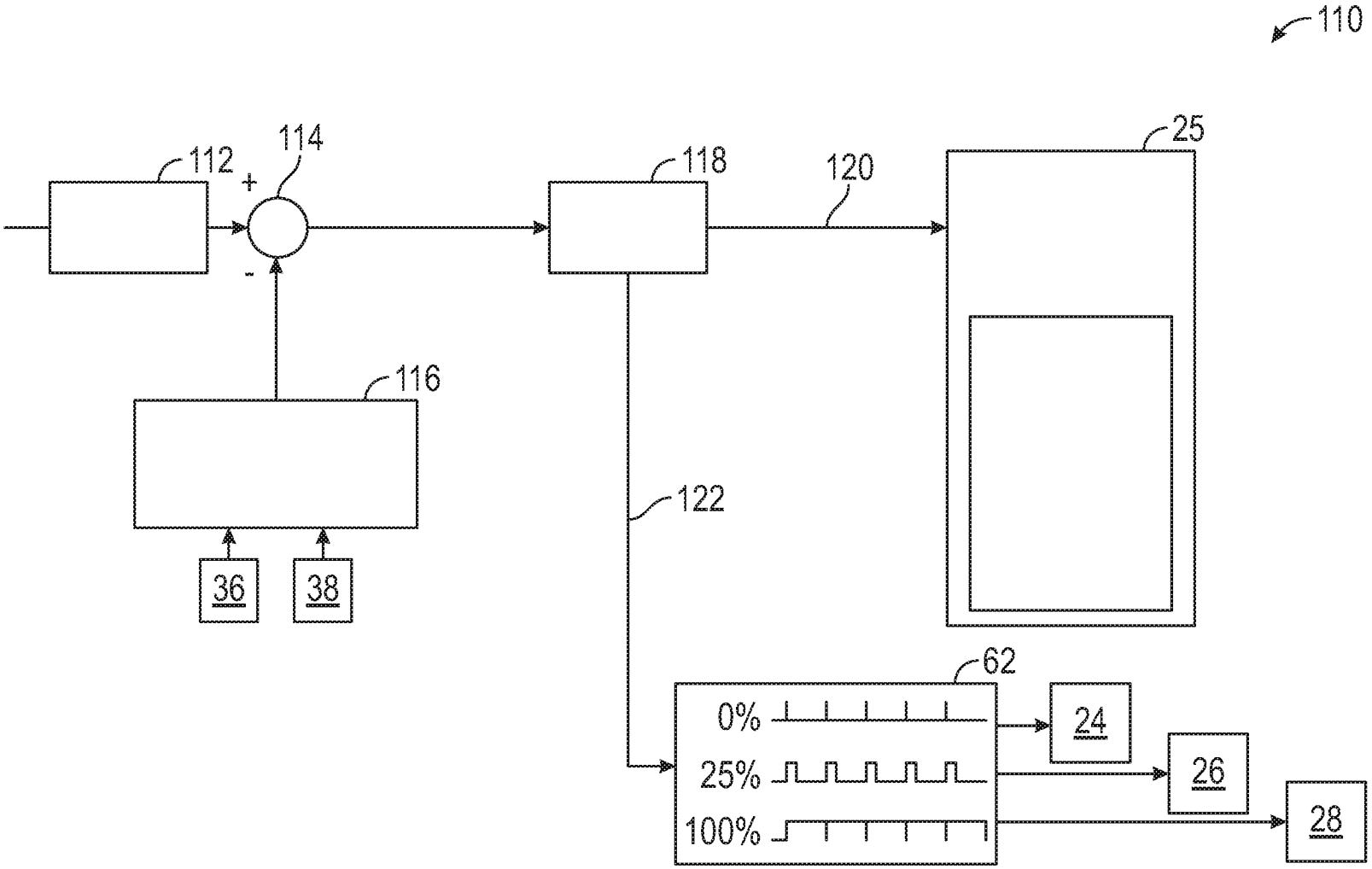
FIG. 3 is a diagram of automatic climate control for the vehicle of FIG. 1, in accordance with various embodiments.

Referring to FIG. 3, power to the PTC radiant patches 24, 26, 28 is controlled using PWM in the power supply 62 based on the ambient $T_a$ and $T_c$ to provide optimal comfort. For example, the power supply 62 is controlled to supply current with PWM control at 0% for a cabin temperature $T_c$ above an upper threshold and 100% for the cabin temperature below a lower threshold temperature. Between the upper and lower threshold temperatures, PWM is varied in relation to the cabin temperature $T_c$ with more power supplied at lower temperatures. The surface temperatures of the PTC radiant patches 24, 26, 28 are set by varying the power supplied to improve occupant thermal comfort of the occupant 31 based on Equivalent Homogenous Temperature (EHT). An automatic climate control system 110 based on EHT is provided through modules that may be included in the controller 32, in multiple controllers, or in another controller in communication with the controller 32.

In an enclosed space such as the cabin of the vehicle 20, occupant thermal comfort may be affected by environmental parameters that influence body heat loss such as surrounding air temperature, mean radiant temperature, air velocity, direct solar load, and humidity. One such parameter is breath air temperature which may be defined as the dry bulb temperature of the air near an occupant's face. Another parameter, mean radiant temperature may be defined as the uniform surface temperature of an imaginary enclosure in which an occupant would exchange the same amount of radiant heat as in the actual non-uniform space. The factors that affect thermal comfort are those that affect the body heat loss. Accordingly, heat loss has an effect on how the occupant 31 perceives thermal comfort/discomfort. The EHT is a recognized measure of the total heat loss from the human body that can be used to characterize highly non-uniform thermal environments. It is particularly useful in relation to a confined space such as a vehicle passenger compartment due to the complex interaction of radiation and convection heat fluxes. EHT expresses the effects of combined thermal influences in a single variable that is associated with occupant thermal comfort. EHT may be determined according to known methods such as by calculation at an EHT evaluation module 112 using $T_a$ and $T_c$ as inputs. EHT is a quantity that integrates the effects of breath level air temperature, air velocity and mean radiation to reflect an occupant body heat loss and thus accurately expresses combined thermal effects on an occupant in a single variable that accurately reflects occupant thermal comfort.

Calculations to determine EHT are carried out in the controller 32 using known methods. The monitored and evaluated EHT is used as feedback to make adjustments in the HVAC system 25 for thermal comfort of the occupant(s) 31. A lookup table may be provided for EHT set point based on input parameters for occupant thermal comfort. Comparator module 114 receives an input from set point module 116 representative of the cabin temperature set point corrected by radiant heating from the PTC radiant patches 24, 26, 28. For example, a lookup table is used that considers $T_c$, and a radiant heating input parameter to provide a set point for control of the HVAC system 25 and the PTC radiant patches 24, 26, 28 in relation to the cabin EHT. Comparator module 114 subtracts the set point provided from set point module 116 from the EHT evaluation module 112 and issues a control error, also referred to as ΔFHT. For example, a negative control error indicates that the HVAC system 25 and/or the PTC radiant patches 24, 26, 28 must adjust the EHT upward by the ΔFHT. The control error is provided to EHT control module 118.

Figure 4:
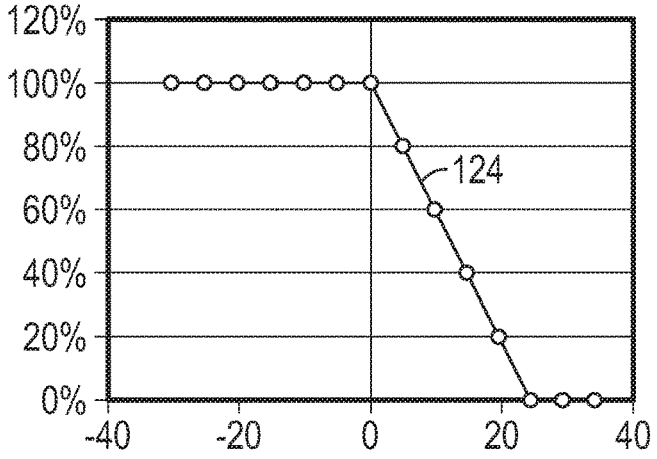
FIG. 4 is a graph of PWM percent versus EHT for powering the PTC radiant patches of FIG. 1, in accordance with various embodiments.

The EHT control module 118 determines a control value $Y_n=10\cdot T_a+Y_{pi}(\Delta EHT_c)$ that may be a combination of steady state ($10\cdot T_a$), and transient ($Y_{pi}(\Delta EHT_c)$), temperature based components. The control value $Y_{pi}$ is determined by $K_p(\Delta EHT_c)+K_i\int(\Delta EHT_c)d\tau$, where $K_p$ is a proportional gain constant and $K_i$ is integral gain. In a number of embodiments, the control value $Y_{pi}$ may be read from a lookup table by the controller 32 where control values are listed in relation to control error value. The determined control values $Y_n$, are provided through signals 120, 122 respectively, where commands are sent to the HVAC system 25 to set a discharge air temperature using the actuator 52, the speed of blower 48, and the HVAC mode through the actuators 56, and to the power supply 62 of the PTC radiant patches 24, 26, 28 for activation. A command is also delivered to the power supply 62 to supply current to the PTC radiant patches 24, 26, 28 for radiant heating of the occupant 31 at a PWM percentage, suitable for the conditions. Feedback provided by the sensors 36, 38 is used to adjust the control value as the cabin temperature approaches the set point temperature. Radiant heat gains are characterized to rapidly improve the EHT for comfort of the occupant 31. An example curve 124 is shown in FIG. 4 where PWM percent is depicted on the vertical scale and EHT is depicted on the horizontal scale. Current is applied with PWM control such that 0% PWM is provided for an EHT greater than 25 degrees Celsius and 100% PWM is provided for and EHT less than 0 degrees Celsius. Between 0 and 25 degrees Celsius, PWM is varied linearly (in this example), with the EHT. In other embodiments, PWM is varied in other ways, including non-linearly if desired. Characteristics of the curve 124 is determined through evaluation as part of calibration and the profile of the curve 124 is particular to a given environment/application.

In scenarios where the EHT is significantly below a comfort zone, the EHT control module 118 activates the PTC radiant patches 24, 26, 28 by signaling the power supply 62 to supply current to the PTC radiant patches 24, 26, 28. For example, on an exemplary comfort scale, a comfort rating of 1 may be classified as cold, a comfort rating of 2 may be classified as very cool, a comfort rating of 3 may be classified as cool, a comfort rating of 4 may be classified as slightly cool, a comfort rating of 5 may be classified as comfortable, a comfort rating of 6 may be classified as slightly warm, a comfort rating of 7 may be classified as warm, a comfort rating of 8 may be classified as too warm, and a comfort rating of 9 may be classified as hot. The comfort ratings are determined in the EHT control module 118, such as from a lookup table using the ΔEHT. If the EHT falls in the 1-3 comfort rating range, the EHT control module 118 commands the activation of the PTC radiant patches 24, 26, 28 and initiates the supply of current thereto by the power supply 62. Concurrently, such as in a vehicle with an engine coolant based heating system which is slow to warm up, the EHT control module 118 slows or disables the blower 48 so that it does not blow cold air, which would cool the occupant 31. The automatic climate control system 110 continues to monitor EHT, and as the ΔEHT becomes lower, meaning the cabin is warming toward a comfortable comfort rating, the EHT control module 118 signals the power supply 62 to reduce PWM current to one or more of the PTC radiant patches 24, 26, 28 and/or increase speed of the blower 48.

Figure 5:
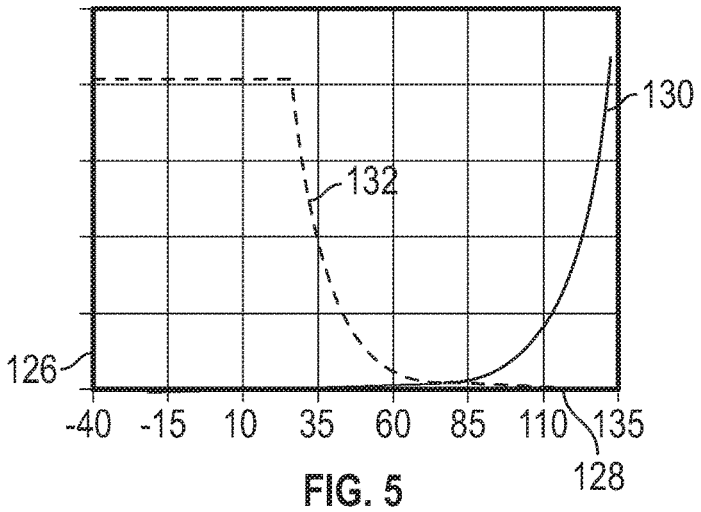
FIG. 5 is a graph of resistance and power versus PTC patch temperature, for the PTC patches of FIG. 1, in accordance with various embodiments.

As shown in FIG. 5, a graph illustrates resistance and power on the vertical scale 126 versus set surface temperature of the PTC radiant patches 24, 26, 28 on the horizontal scale 128. Electrical resistance 130 of the PTC radiant patches 24, 26, 28 increases exponentially below the set temperature (135 degrees Celsius in this example). The PTC radiant patches 24, 26, 28 do not exceed the set temperature as the power 132 approaches zero due to an exponential increase of the electrical resistance when the radiant patch temperature approaches the set temperature. In other words, the resistivity grows exponentially with increasing temperature up to a set temperature where the PTC radiant patches 24, 26, 28 cease conducting electricity. The set temperature is a function of the material properties of the PTC radiant patches 24, 26, 28 and is selectable independently for different individual patches.

Figure 6:
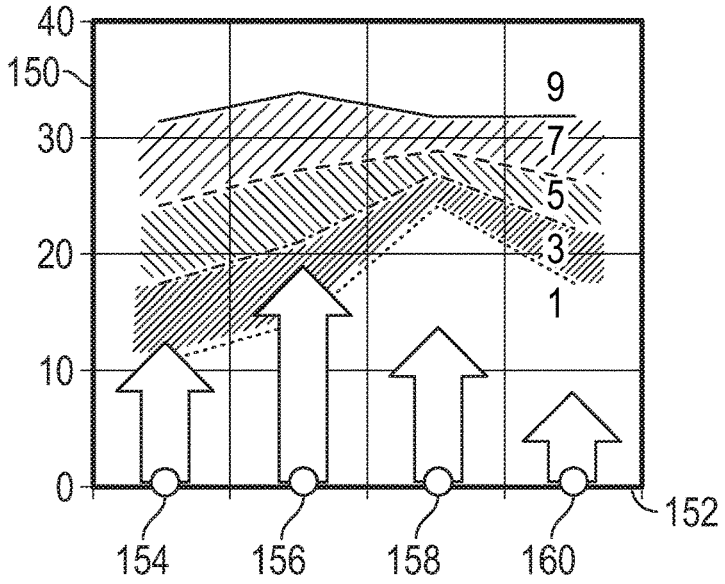
FIG. 6 is a graph of EHT versus targeted radiant heating of body segments, in accordance with various embodiments.

The PTC radiant patches 24, 26, 28 are applied in the interior of the vehicle 20 to provide a targeted radiant heat to different occupant body segments. Multi-zone targeted heating provides an optimum power savings. For example, as shown in FIG. 1, the PTC radiant patch 26 is positioned on the lower dash panel 140 under the steering wheel 142 and targets the leg area of the occupant 31. The PTC radiant patch 28 is positioned on the door 144 and targets the arm and shoulder area of the occupant 31. The PTC radiant patch 24 is positioned on the headliner/roof 146 and targets the head and upper body of the occupant 31. As shown in FIG. 6, EHT on the vertical scale 150 is depicted as zones for comfort ratings of: 1 (cold), 3 (cool), 5 (comfortable), 7 (warm) and 9 (hot), in relation to different body segments on the horizontal scale 152. These body segments include the head 154, the hand 156, the leg/thigh 158 and the upper body 160. FIG. 6 shows, for example, that the head 154 and the hand 156 feel less cold at the same EHT than do the leg/thigh 158. FIG. 6 also shows that the upper body 160 feels cool at a higher EHT than the head 154 or the hand 156, but feels comfortable at a lower EHT than the leg/thigh 158. Accordingly, the PTC radiant patches 24, 26, 28 are supplied with different power levels to target different areas of the occupant to create a warm feeling quickly. For example, to achieve instantaneous improvement at low EHTs, the PTC radiant patches 26, 28 are supplied with 100% PWM to target the leg/thigh area of the occupant 31, while the PTC radiant patch 24 is supplied with 50% PWM since the head/upper body does not feel as cold as the leg/thigh at the same EHT. In other embodiments or at higher EHTs, the PWM percentage of the PTC radiant patch 28 is reduced while maintaining 100% PWM for the PTC radiant patch 26 because the upper body 160 feels comfortable at a lower EHT than the leg/thigh 158.

Figure 7:
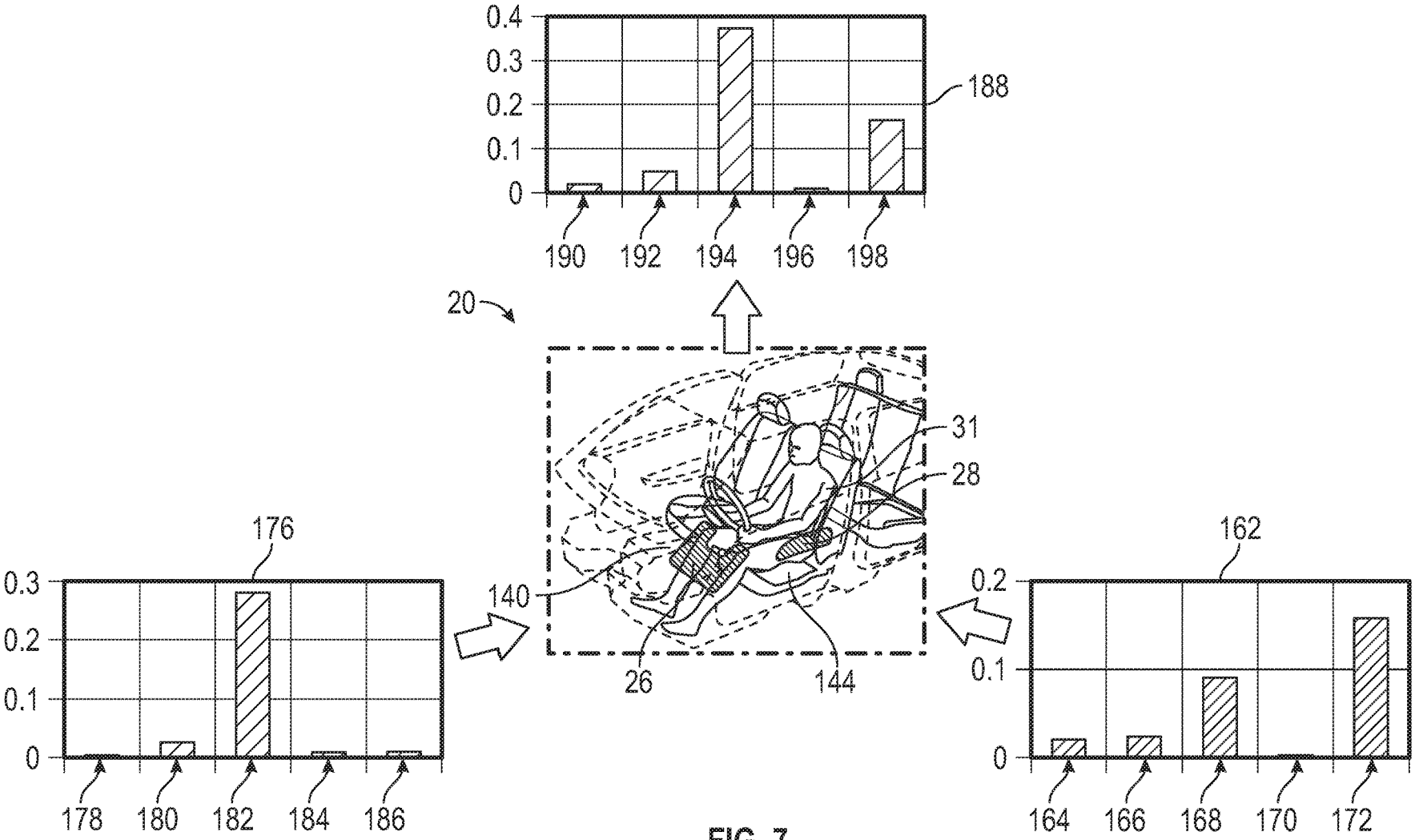
FIG. 7 is an illustration of targeted radiant heating using PTC patches based on view factors, in accordance with various embodiments.

Multi-zone targeted heating considering view factor is depicted in FIG. 7. In radiative heat transfer, a view factor is the proportion of the radiation which leaves a surface that strikes another surface. In a complex scene such as the interior of the vehicle 20, there are many available surfaces surrounding the occupant 31. While the current embodiment shows PTC radiant patches 24, 26 and 28, any number of additional or alternative surfaces surrounding the occupant may be used for locating PTC radiant patches. The box 162 shows view factors of 0.0-0.2 for the head 164, hand 166, leg/thigh 168, foot 170 and arm/shoulder 172 as they relate to the radiant heat that leaves the PTC radiant patch 28 and strikes the occupant 31. This shows that the PTC radiant patch 26 on the lower dash panel 140 is particularly useful in targeting the arm/shoulder of the occupant 31, and is moderately effective at targeting the leg/thigh area. The box 176 shows view factors of 0.0-0.3 for the head 178, hand 180, leg/thigh 182, foot 184 and arm/shoulder 186 as they relate to the radiant heat that leaves the PTC radiant patch 26 and strikes the occupant 31. This shows that the PTC radiant patch 26 on the lower dash panel 140 is particularly useful in targeting the leg/thigh of the occupant 31. Accordingly, the view factors are used to control the PTC radiant patches 26 and 28 to target the areas of the occupant 31 that will most quickly induce a warmer feeling, as shown by FIG. 6 and as described above. The box 188 shows the combined view factor of the PTC radiant patches 26, 28 between view factors of 0.0-0.4. This is depicted for the head 190, hand 192, leg/thigh 194, foot 196 and arm/shoulder 198 as they relate to the radiant heat that leaves the PTC radiant patches 26, 28 and strikes the occupant 31. Box 188 shows that the combined PTC radiant patches 26, 28 are used to warm the leg/thigh 194 and arm/shoulder 198, which as demonstrated by FIG. 6, effectively leads to a more comfortable occupant 31.

Accordingly, when rapid warming of an occupant is needed, a PTC radiant heating system and method provides an effective solution. While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A radiant heating system for warming an occupant of an enclosed space, the system comprising:

a sensor configured to sense a temperature of the enclosed space;

a first patch configured to radiate heat into the enclosed space toward a first segment of the occupant;

a second patch configured to radiate heat into the enclosed space toward a second segment of the occupant;

a power supply configured to supply electric power to the first and second patches; and a controller configured to:

supply multi-zone targeted heating considering a first view factor and a second view factor, where the first and second view factors are proportions of radiation projected to leave the first and second patches respectively, and that strike the first and second segments of the occupant, respectively; and supply, through the power supply, the first and second patches with first and second signals, respectively, where:

the first and second signals are set to one-hundred percent pulse-width modulation when the temperature is below a lower threshold, the first and second signals are set to zero percent pulse-width modulation when the temperature is above an upper threshold, and when the temperature is between the upper and lower thresholds the first and second signals are independently set, with the first signal set to a first percentage pulse-width modulation based on the first view factor and the second signal is set to a second percentage pulse-width modulation based on the second view factor.

2. The system of claim 1, comprising an occupant sensor configured to determine an occupant state, wherein the controller is configured to:

determine, based on the occupant state, which of the first and second patches to activate/deactivate;

determine, based on the first and second view factors, an occupant comfort level; and set the supply of electric power to each of the first and second patches that are activated, wherein the supply of electric power is based on the occupant comfort level.

3. The system of claim 2, comprising a heating, ventilation and air conditioning system including a blower, wherein the controller is configured to supply electric current to the first and second patches and to stop the blower when the temperature in the enclosed space is lower than a comfortable range.

4. The system of claim 1, comprising:

a first sensor configured to determine an ambient temperature outside the enclosed space; and a second sensor configured to determine a cabin temperature inside the enclosed space; and wherein the controller is configured to control the supply of electric current to the first and second patches based on the ambient temperature and the cabin temperature.

5. The system of claim 1, wherein the enclosed space is a cabin of a vehicle and comprising:

a lower dash panel on which the first patch is positioned; and a door on which the second patch is positioned;

wherein the controller is configured, at a given temperature, to reduce the power to the first patch while maintain a constant power level to the second patch.

6. The system of claim 1, wherein the controller is configured to:

determine a control value that is a combination of steady state and transient temperature based components by $K_p(\Delta EHT_c)+K_i\int(\Delta EHT_c)d\tau$, where $K_p$ is a proportional gain constant and $K_i$ is integral gain, and $(\Delta EHT_c)$ is a control error from a setpoint; and deliver the determined control values to set a discharge air temperature, blower speed, HVAC mode, and the power supply to the first and second patches.

7. The system of claim 6, wherein the controller is configured to reduce the power supply to at least one or more of the patches as the $\Delta EHT_c$ becomes lower.

8. A radiant heating system for warming an occupant of a vehicle with a cabin, the system comprising:

at least two patches configured to radiate heat into an enclosed space toward the occupant;

a power supply connected with the at least two patches;

a heating, ventilation and air conditioning (HVAC) system configured to condition the cabin to a set temperature; and a controller configured to:

calculate an equivalent temperature in the enclosed space;

determine a comfort rating based on the calculated equivalent temperature;

control, based on the comfort rating, the power supply to supply electric current to the at least two patches, independently via first and second signals;

set the power supply to one-hundred percent pulse-width modulation when the temperature is below a lower threshold;

set the power supply to zero percent pulse-width modulation when the temperature is above an upper threshold;

when the temperature is between the upper and lower thresholds, set the first and second signals independently, with the first signal set to a first percentage pulse-width modulation based on a first view factor and the second signal is set to a second percentage pulse-width modulation based on a second view factor, where the first and second view factors are proportions of radiation projected to leave the at least two patches, and strike first and second segments of the occupant, respectively; and control the heating, ventilation and air conditioning (HVAC) system;

wherein the power supply and the heating ventilation and air conditioning (HVAC) system are controlled in coordination based on the set temperature.

9. The system of claim 8, comprising:

a first sensor configured to determine an ambient temperature outside the cabin; and a second sensor configured to determine a cabin temperature inside the cabin;

wherein the controller is additionally configured to control the power supply based on the ambient temperature and the cabin temperature.

10. The system of claim 8, wherein the equivalent temperature comprises a measure of total heat loss from the occupant and is calculated based on an ambient temperature and a cabin temperature.

11. The system of claim 8, wherein the at least two patches each have a respective patch temperature and each is comprised of a positive thermal coefficient material that exhibits an electrical resistance that increases exponentially with increases in the patch temperature.

12. The system of claim 8, wherein the at least two patches comprise a first patch and a second patch that is directed at a different segment of the occupant than the first patch, wherein the controller is configured to:

determine whether the equivalent temperature has reached a threshold;

reduce, when the threshold is reached, the power supply to the first patch while maintaining one-hundred percent of the power supply to the second patch to heat the two segments differently based on the comfort rating; and control electric current to the first and second patches based on locations of the segments to which they are directed.

13. The system of claim 8, wherein the controller is configured to:

determine equivalent homogeneous temperature (EHT) in the cabin; and when the equivalent homogeneous temperature (EHT) approaches the set temperature, signal the power supply to reduce current to the at least two patches.

14. The system of claim 13, wherein the HVAC system includes a blower and the controller is configured to increase speed of the blower when the current to the patch is reduced.

15. A method of warming an occupant of an enclosed space, the method comprising:

positioning a first radiant patch at a first location to radiate heat into the enclosed space toward the occupant;

positioning a second radiant patch at a second location to radiate heat into the enclosed space toward the occupant;

connecting a power supply to the first and second radiant patches;

positioning a sensor configured to sense a temperature of the enclosed space;

supplying multi-zone targeted heating considering a first view factor and a second view factor, where the first and second view factors are proportions of radiation projected to leave the first and second patches respectively, and that strike the first and second segments of the occupant, respectively;

supplying the first and second patches with first and second signals through the power supply, respectively;

setting the first and second signals to one-hundred percent pulse-width modulation when the temperature is below a lower threshold;

setting the first and second signals to zero percent pulse-width modulation when the temperature is above an upper threshold, and when the temperature is between the upper and lower thresholds, independently setting the first and second signals, with the first signal set to a first pulse-width modulation percentage based on the first view factor and the second signal is set to a second pulse-width modulation percentage based on the second view factor.

16. The method of claim 15, wherein the enclosed space is a vehicle, the first radiant patch is positioned on a lower dash panel, the second radiant patch is positioned on a door, and wherein the controller, at a given temperature, reduces the electric power to the first radiant patch while maintain a constant electric power level to the second radiant patch.

17. The method of claim 15, comprising:

positioning a third radiant patch on a roof of the vehicle; and when the temperature is below a threshold temperature, supplying electric power to the first, second and third radiant patches.

18. The method of claim 15, comprising:

determining, using the temperature, an equivalent homogeneous temperature (EHT) in the enclosed space; and when the EHT approaches a set temperature, signaling the power supply to reduce current to the first and second patches.

19. The method of claim 15, comprising making the first and second patches of a positive thermal coefficient material that exhibits an electrical resistance that increases exponentially as a patch temperature of the first and second patches rises.

20. The method of claim 15, comprising:

conditioning, by a heating, ventilation and air conditioning (HVAC) system, the enclosed space to a set temperature; and controlling the power supply and the HVAC system in coordination based on the temperature, wherein the temperature characterizes comfort of the occupant.

* * * * *